US006530337B1

(12) United States Patent
Hoffman

(10) Patent No.: US 6,530,337 B1
(45) Date of Patent: Mar. 11, 2003

(54) UNDERWATER EXPLOSION PROTECTION FOR WATERCRAFT

(75) Inventor: Mark W. Hoffman, Manassas, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/082,387

(22) Filed: Mar. 18, 2002

(51) Int. Cl.[7] ..... B63B 5/20

(52) U.S. Cl. ..... 114/361; 114/14; 114/219; 114/357; 89/36.12; 244/121; 428/212

(58) Field of Search ..... 114/14, 219, 357, 114/361; 89/36.12; 428/212; 244/121

(56) References Cited

U.S. PATENT DOCUMENTS

| | | | | | |
|---|---|---|---|---|---|
| 860,382 | A | * | 7/1907 | Hoyoss | |
| 2,697,054 | A | * | 12/1954 | Dietz et al. | |
| 4,094,027 | A | * | 6/1978 | Vernon | 114/357 |
| 4,111,097 | A | * | 9/1978 | Lasker | 109/83 |
| 4,292,882 | A | * | 10/1981 | Clausen | 109/49.5 |
| 4,529,640 | A | * | 7/1985 | Brown et al. | 109/82 |
| 4,732,803 | A | * | 3/1988 | Smith, Jr. | 109/49.5 |
| 4,879,165 | A | * | 11/1989 | Smith | 109/49.5 |
| 4,892,055 | A | * | 1/1990 | Schad | 114/219 |
| 5,005,510 | A | * | 4/1991 | Schad | 114/343 |
| 5,117,764 | A | * | 6/1992 | Kretzer, Jr. | 114/361 |
| 5,200,256 | A | * | 4/1993 | Dunbar | 109/49.5 |
| 5,266,245 | A | * | 11/1993 | Wellings | 114/355 |
| 5,431,831 | A | * | 7/1995 | Vincent | 106/33 |
| 5,628,490 | A | | 5/1997 | Roberts et al. | 251/57 |
| 5,803,009 | A | * | 9/1998 | Audoly | 114/312 |
| 6,148,754 | A | * | 11/2000 | Sims, Jr. | 114/219 |
| 6,192,818 | B1 | | 2/2001 | Rogers-Smith | 114/219 |

FOREIGN PATENT DOCUMENTS

| | | |
|---|---|---|
| GB | 2228893 | * 12/1990 |
| GB | 2245217 | * 2/1992 |

* cited by examiner

*Primary Examiner*—Michael J. Carone
*Assistant Examiner*—John Richardson
(74) *Attorney, Agent, or Firm*—Jacob Shuster

(57) ABSTRACT

The underwater exterior surface of a watercraft is covered by a deformable protective covering formed from compartmental sections that are dimensionally sized, shaped and mechanically connected to each other for effective attachment of the assembled covering to and removal from the hull of the watercraft. The protective covering is of a cross-sectional construction arranged to provide protection against the damaging effects of underwater explosions by minimizing related adverse physical effects on the entire hull of the watercraft as well as mechanical and electrical components associated therewith.

5 Claims, 1 Drawing Sheet

UNDERWATER EXPLOSION PROTECTION FOR WATERCRAFT

STATEMENT OF GOVERNMENT INTEREST

The invention described herein may be manufactured and used by or for the Government of the United States of America for governmental purposes without the payment of any royalties thereon or therefore.

The present invention relates generally to protecting watercraft against damage from underwater explosion effects.

BACKGROUND OF THE INVENTION

The passive protection for different shapes and sizes of watercraft from underwater damage by applying a deformable cover device to its exterior underwater hull surface is generally known in the art, as disclosed for example in U.S. Pat. No. 6,192,818 B1 to Rogers-Smith. Such protective devices have been attached to the bow portion of the watercraft hull for limited protection from damage caused by physical collision with water borne objects such as trailers, docks, debris and other watercraft. Such a prior art protective cover device is not only confined to the bow portion of the hull, but is of uniform thickness throughout and is permanently attached to the hull surface by means of adhesive. It is therefore an important object of the present invention to provide a more readily attached and removable protection device for the entire underwater hull surface of a watercraft to protect it against damage from underwater explosion effects.

SUMMARY OF THE INVENTION

In accordance with the present invention, protective coverings for the underwater hull surfaces of different watercraft are provided. Such a protective covering is shaped and sized to conform to the entire underwater hull surface and is of varying thickness to accommodate and most effectively protect different compartments covered by sections of the covering which are mated and interconnected, as well as readily disconnected mechanically for attachment of an assembled covering to the watercraft hull and removal therefrom at any port, including entry location ports, to which such covering sections may be transported by towing or self-propelled propulsion means. The protective hull covering sections are constructed so as to provide the desired shock mitigating and shock absorbing properties as well as to add mass and stiffness to enhance protection of the watercraft's hull as well as mechanical and electrical components against damage by underwater explosion effects. Also, the protective covering may accommodate hull carried features such as water flow baffles and a detachable ballast keel.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENTS

Figure 1:
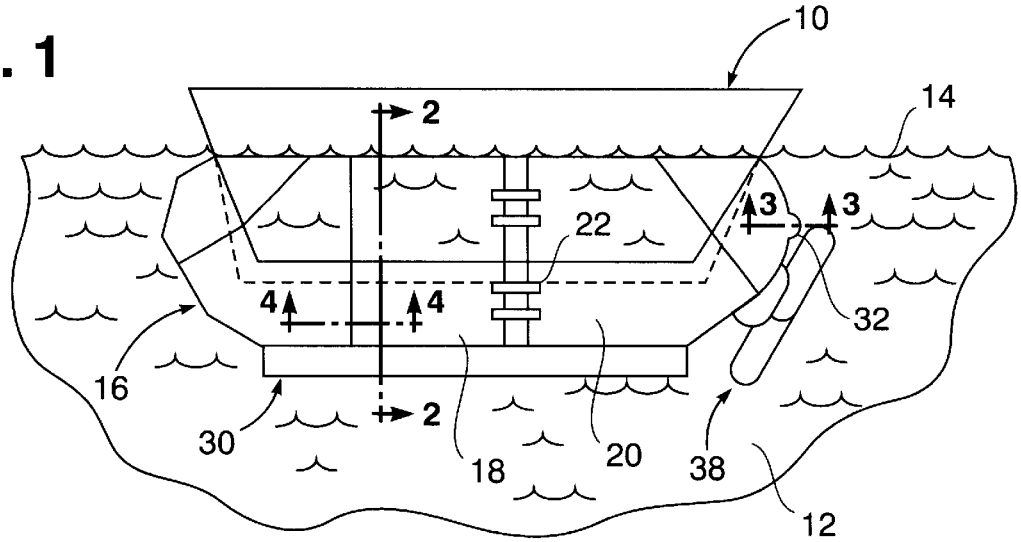
FIG. 1 is a simplified side elevation view of a water surface watercraft vessel with is a protective covering device applied thereto pursuant to one embodiment of the present invention.

Referring now to the drawing in detail, FIG. 1 illustrates rather diagrammatically in side view a hull 10 of a watercraft such as a water surface marine vessel within a body of seawater 12. Protection for the entire hull 10 below the seawater surface 14 pursuant to the present invention is provided by a module covering device 16 as a protective cover. Such covering device 16 is shaped and dimensioned for mechanical attachment and removal with respect to multiple sections or magazines of the hull 10, such as forward and aft hull subsections 18 and 20 interconnected by means of mechanical attachments 22. Within the subsections 18 or 20, compartments of a specialized protective type may be established by internal lining with armor to enclose explosive or other dangerous materials within reactor or magazine spaces in the hull 10.

Figure 2:
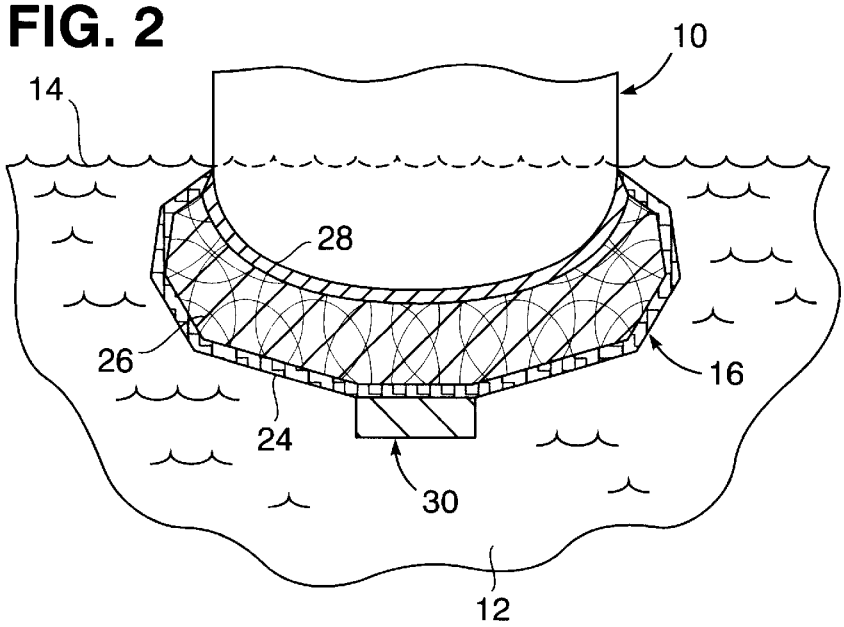
FIG. 2 is a side section view taken substantially through a plane indicated by section line 2—2 in FIG. 1.
Figure 3:
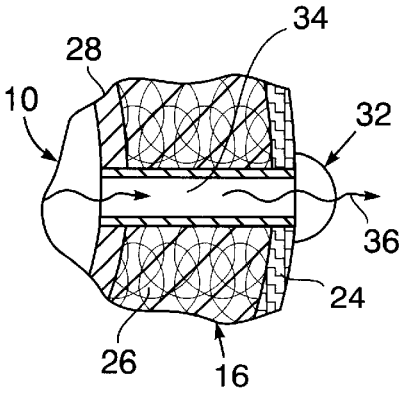
FIG. 3 is a partial enlarged section view taken substantially through a plane indicated by section line 3—3 in FIG. 1.
Figure 4:
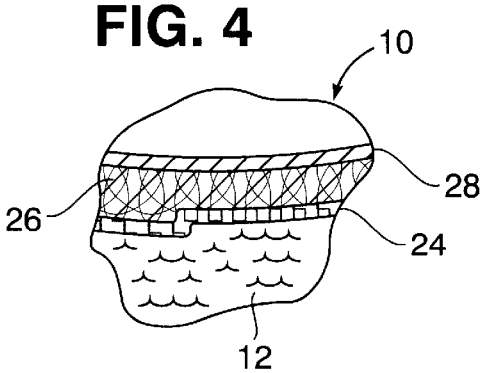
FIG. 4 is an enlarged partial section view taken substantially through a plane indicated by section line 4—4 in FIG; 1.

Referring now to FIGS. 2, 3 and 4, the protective covering 16 has a relatively deformable externally outer retention layer 24 enclosing shock mitigating/absorbing materials 26, such as foams, air barriers, air bags, etc. The external underwater surface of the hull 10, so protectively covered, is coated with a relatively thin protective coating 28. The foregoing arrangement of the protective module covering device 16 is such as to maintain neutral buoyancy and stiffness of the hull 10, while reducing overall beam-like motions and local shock responses induced by underwater explosion effects.

As also shown in FIGS. 1 and 2, a variable ballast keel 30 for the hull 10 may be attached to the bottom of the protective covering 16. Such hull 10 may also have a baffle 32 attached as shown in FIGS. 1 and 3, with a flow passage 34 extending through the protective module covering device 16 to allow water flow 36 relative to the vessel's propulsion system 38 or relative to cooling systems.

The constructional arrangement of compartmental portions of the protective covering device 16 respectively associated with the multiple hull sections as hereinbefore described, may have different thickness and weight density as shown in FIG. 4, related to different hull compartments so as to accommodate differences between the protective requirements associated therewith against underwater explosion effects as the damaging agents. The protective covering device 16 as hereinbefore described with respect to the hull of a water surface vessel, may be modified in shape and dimensions pursuant to the present invention to accommodate protection against underwater explosion effects for other types of watercraft such as submersible vessels, basically involving changes in weight-to-displacement relationships and shape while maintaining critical features such as compartmentation as a key survivability aspect and mechanical attachment of the covering sections for easy application or removal of the protective covering from the watercraft hull when at a port or neat a watercraft entry location port.

What is claimed is:

1. A device for watercraft to be protected against damage caused by underwater explosive effects, comprising: a protective covering made of shock-absorbing material shaped and dimensioned for attachment to and removal from an entire underwater exterior hull surface of the watercraft; a protective coating in complete contact throughout with said underwater exterior surface and the covering when attached thereto; an outer retention layer externally enclosing the protective covering; and means for mechanically effecting said attachment and removal of the covering said protective covering being formed from compartmental sections of the protective covering varying in thickness and material properties.

2. The device as defined in claim 1, wherein the watercraft is a water surface vessel.

3. A device for watercraft of different shapes and sizes to be protected against damage caused by underwater explosive effects, comprising: a protective covering shaped and dimensioned for attachment to and removal from an entire underwater exterior hull surface of the watercraft; a protective coating on said underwater exterior surface contacted by the covering when attached thereto; and means for mechanically effecting said attachment and removal of the covering, the watercraft being a submersible vessel.

4. The combination as defined in claim 2, wherein the water surface vessel has underwater portions thereof attached to the hull surface by the protective covering.

5. The combination as defined in claim 4, wherein said underwater portions attached to the hull surface by the protective covering includes a ballast keel.

* * * * *